United States Patent [19]

Atago et al.

[11] 4,383,506

[45] May 17, 1983

[54] ENGINE ROTATION SPEED CONTROL SYSTEM

[75] Inventors: Takeshi Atago; Toshio Manaka, both of Katsuta, Japan

[73] Assignee: Hitachi, Ltd., Tokyo, Japan

[21] Appl. No.: 218,672

[22] Filed: Dec. 22, 1980

[30] Foreign Application Priority Data

Dec. 28, 1979 [JP] Japan ..... 54-170527
Dec. 28, 1979 [JP] Japan ..... 54-170528

[51] Int. Cl.[3] ..... F02N 17/00
[52] U.S. Cl. ..... 123/179 G
[58] Field of Search ..... 123/339, 340, 341, 361, 123/376, 403, 179 G

[56] References Cited

U.S. PATENT DOCUMENTS

| | | | |
|---|---|---|---|
| 3,081,846 | 3/1963 | Lift | 188/298 |
| 3,266,473 | 8/1966 | Rhodes | 123/328 |
| 3,621,824 | 11/1971 | Burnia et al. | 123/339 X |
| 3,964,457 | 6/1976 | Coscia | 123/179 L |
| 4,212,272 | 7/1980 | Hawk | 123/339 |

*Primary Examiner*—William A. Cuchlinski, Jr.
*Attorney, Agent, or Firm*—Antonelli, Terry & Wands

[57] ABSTRACT

An engine rotation speed control system which comprises an actuator for prescribing the recovery position of a throttle valve, a recovery position sensor for detecting that the throttle valve is returned to the recovery position, an idle speed control unit for controlling the engine to a predetermined idling speed, and a negative pressure restricting unit for controlling the throttle actuator such that reduction in intake negative pressure to below a predetermined negative pressure is prevented. When the throttle valve returns to the recovery position with the engine speed in excess of an upper limit of the idling speed, the actuator is controlled by the negative pressure restricting unit. When the engine speed falls below the upper limit, the idle speed control unit is actuated. Upon engine starting the actuator is set such that the opening degree of the throttle valve suitable for the engine starting is obtained before the starter starts operating.

9 Claims, 14 Drawing Figures

ENGINE ROTATION SPEED CONTROL SYSTEM

BACKGROUND OF THE INVENTION

1. Field of the Invention

The present invention relates to a rotation speed control system based on a throttle valve recovery position control scheme and being for use with an internal combustion engine such as a gasoline engine.

2. Description of the Prior Art

In internal combustion engines for vehicles such as automobiles, the engine is necessarily kept, for a relatively long time, in a so-called idling operation or mode in which the engine idles without contributing to delivery of power therefrom. During the idle mode, irrespective of the idle mode during warm-up immediately after starting the engine start or during normal operation following completion of the warm-up, the engine speed varies with various factors such as, for example, intake air temperature (external air temperature), cooling water temperature and oil condition, and is not always kept constant.

To follow the recent trend of imposing stringent regulations on engine-powered vehicles such as automobiles, the idling operation is to be controlled more strictly than before so as to be made compatible with the regulatory control for polluting exhaust gas and there is a need for the development of a system which can always maintain the engine at a minimum rotation speed at which a misfire is not caused, during the idling mode.

Also, contemporary innovation by electronic technology is spreading to the field of engine carburators so that a carburetor which is controlled by an associated microcomputer, that is, a so-called electronically controlled carburetor (hereinafter referred to as ECC) may be placed on the market. With the ECC, the engine operation is controlled automatically, especially, to control the engine idle speed at a constant value. An approach to an idle speed control (hereinafter referred to as ISC) by means of the ECC is disclosed in U.S. Pat. No. 3,964,457.

With the ISC, it is possible to control the idle speed at a predetermined fixed value, without fail, which is reconciled with the stringent regulations on the engine idle speed. However, difficulties are encounters in the ISC. More particularly, according to the ISC, when the accelerator pedal of the automobile is depressed to draw the engine out of the idling mode and thereafter the accelerator pedal is released to return the engine to the idling mode, the engine operation is changed rapidly so that the engine rotation becomes unstable and a temporary reduction of the engine speed to below the idle speed occurs, resulting in engine stalling, large shocks in the running of automobiles, and misfiring due to a rapid increase in the intake negative pressure which leads to polluting exhaust gas.

Further, in the ISC, it is inevitable from the viewpoint of the regulations on exhaust gases to monitor the intake negative pressure and to control the negative pressure to below a predetermined negative pressure (to above the absolute value thereof), for example, −570 mmHg. This results from the condition that, when the intake negative pressure increases to exceed a critical value (in terms of absolute value), the exhaust gas condition is degraded rapidly, thus failing to satisfy the exhaust gas regulations. An approach to this problem is the provision of a throttle opener as disclosed in U.S. Pat. No. 3,266,473, for example, by which, when the intake negative pressure exceeds a predetermined value, an actuator is controlled such that the opening degree of the throttle valve is increased in preference to the controlling of the idle speed.

With the throttle opener, when the throttle valve returns to the recovery position determined by the actuator upon release of the accelerator pedal by the driver, causing a rapid decrease in the intake negative pressure which exceeds a critical negative pressure preset by the throttle opener, the throttle opener immediately responds thereto in order to control the actuator such that the intake negative pressure can be returned to the preset value. Since the actuator operates at a slow response speed, the intake negative pressure once exceeds the preset value and then approaches it, thereby greatly shortening the time interval during which the exhaust gas condition is degraded. However, since, in the course of this transitional operation of the throttle valve, the intake negative pressure fluctuates, the engine speed also fluctuates and the temporary decrease in the engine speed may cause the throttle opener to operate to increase the engine speed again, as a result, for example, when going down a slope, the car speed is temporarily increased to decrease the effect of engine braking whereby the driver experiences an uneasiness, and it causes shocks in the running of automobiles.

One measure to solve this difficulty is to ensure that the recovery or closure of the throttle valve to the idling opening is not effected rapidly but is effected gradually over a given time. Thus, the engine speed can decrease gradually to follow the throttle opening, without causing the rapid decrease in intake negative pressure. Consequently, the throttle opener will not be actuated and the transitional fluctuation in the engine speed can be prevented. Based on this principle, it may be thought to provide a mechanical damper such as a dashpot disclosed in U.S. Pat. No. 3,081,846, for example, for the throttle valve.

However, since the essential feature of the ECC excludes the provision of a mechanical control for the carburetor as a component element thereof for the sake of pure electronic control of various functions, the provision of a mechanical element such as the dashpot for the carburetor conflicts with the essentials for electronic control. Moreover, the provision of the mechanical element raises the cost.

SUMMARY OF THE INVENTION

An object of the invention is to provide an engine rotation speed control system for use with ECCs which is so adapted for an ISC with the throttle opener function as to prevent the occurrence of shocks in the running of automobiles and engine stalling as well as a degradation in the exhaust gas condition when the accelerator pedal is released.

Another object of the invention is to provide an engine rotation speed control system directed to the above object and which, taking into consideration the fact that the recovery position of the throttle valve determined by the action of the actuator varies irregularly when the engine is stopped, can initialize the actuator such that the engine starts with the throttle valve located at a suitable position.

To accomplish the above objects, according to the invention, when the accelerator pedal is depressed, the actuator is operated immediately to cause the recovery position of the throttle valve to take a preset position at which the throttle valve has an opening degree which is sufficiently larger than that at the idling position. Subsequently, when the accelerator pedal is released, the throttle valve shifts from the preset position to the idling position at a relatively small rate while being subject to the throttle opener control. When the throttle valve reaches the idling position, the ISC commences.

DESCRIPTION OF THE PREFERRED EMBODIMENTS

Figure 1:
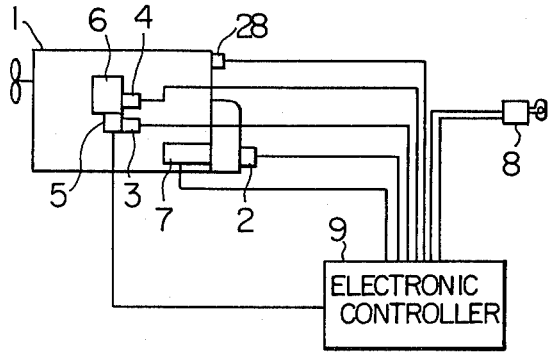
FIG. 1 is a schematic diagram showing the overall construction of an engine rotation speed control system according to the invention.

Referring to FIG. 1, there is shown an engine rotation speed control system embodying the present invention. As shown therein in schematic form, the control system comprises an engine 1 whose rotation speed is detected by an engine rotation speed sensor 2, an idle sensor 3 adapted to detect that the engine is brought into the idle mode by releasing the depression of the accelerator pedal as will be detailed later, an actuator position sensor 4 adapted to detect that a throttle actuator 5 is in a preset position as will be detailed later, a carburetor 6, an engine starter 7, a key switch 8, an electronic controller 9 including a read only memory for storage of a control program, a random access memory for storage of data information, an input/output unit and a control unit, and a temperature sensor 28 for detection of the temperature of engine cooling water.

Figure 2:
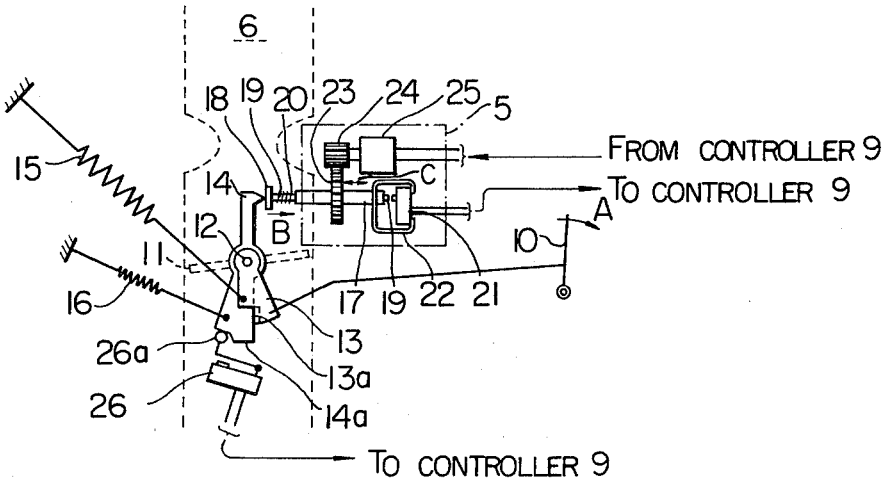
FIG. 2 is a diagrammatic representation useful in explaining the operation of an actuator and throttle valve constituting the essential part of the invention.

Shown in FIG. 2 is an embodiment of the arrangement of the carburetor 6 along with the associated actuator 5, idle sensor 3 and actuator position sensor 4.

With the arrangement as shown in FIG. 2, when an accelerator pedal 10 is depressed to turn in the direction of arrow A, a throttle lever 13 securedly fixed to a rotary shaft 12 of a throttle valve 11 is rotated counter-clockwise. A free lever 14 is rotatably mounted on the shaft 12. The throttle lever 13 is biased clockwise by means of a return spring 15 so that a pawl 13*a* of the throttle lever abuts against the free lever 14 which is biased clockwise by means of a spring 16 so as to constantly engage a contact piece 18. The contact piece 18 is fixed to the fore end of a rod 19 which is slidably inserted in a stopper 17 by passing through an axial bore formed therein. A spring 20 is coiled on the rod 19 between the contact piece 18 and the stopper 17. The rear end of the rod 19 opposes an actuatable button of a microswitch 21 and the microswitch 21 is fixed to the stopper 17 by means of a frame 22. Accordingly, when the contact piece 18 is pushed by a pointed portion of the free lever 14 to the right as shown by arrow B in opposition to the spring 20, the rear end of the rod 19 acts to close the microswitch 21.

The stopper 17 is threaded at its circumferential periphery with a male screw meshing a female screw threaded in a gear 23 and supported by the gear 23. This gear 23 also meshes a gear 24 fixed to a rotary shaft of a pulse motor 25 and it is rotated in response to clockwise or counterclockwise rotation of the pulse motor 25 to move the stopper 17 to and fro (forwardly or backwardly) as shown by arrow C. Since being connected integrally with the stopper 17 by means of the frame 22, the microswitch 21 follows the motion of the stopper 17.

A microswitch 26 is fixed to the body of the engine 1 and actuated by a cam surface 14*a* of the free lever 14.

The spring 20 has a higher resiliency than that of the spring 16. Accordingly, when the pawl 13*a* of the throttle lever 13 is separated from the free lever 14 by depressing the accelerator pedal, the pointed portion of the free lever 14 is urged by the action of the spring 16 to engage the contact piece 18 of the actuator 5 but not to close the microswitch 21. The return spring 15 has a higher resiliency than that of the spring 20. Accordingly, as far as the acceleration pedal 10 is freed from depression, the rod 19 is offset by the action of the return spring 15 toward arrow B in opposition to the force of the spring 20, thereby closing the microswitch 21. Namely, the microswitch 21 is open while the accelerator pedal 10 is depressed but is closed during release thereof, thus constituting the idle sensor 3 shown in FIG. 1.

Although being less resilient than the spring 20, the spring 16 has force sufficient to cause the cam surface 14*a* of free lever 14 to actuate the microswitch 26. The free lever 14 swings about the shaft 12 as the stopper 17 of the actuator 5 is driven by the motor 25 to move to and fro as shown by arrow C. During the swing motion of the free lever 14, the microswitch 26 is switched on or off each time a shoulder on the cam surface 14*a* passes by a roller 26*a* of the microswitch 26 held in a given place. Thus, the microswitch 26 to be switched on or off each time the actuator 5 moves past a given position constitutes the actuator position sensor 4 shown in FIG. 1.

When the engine operates in the idle mode, the electronic controller performs the ISC. More particularly, with reference to FIG. 1, the electronic controller 9 receives the signal from the idle sensor 3 to detect that the engine is in the idle mode, and fetches engine speed data from the engine rotation speed sensor 2 and data regarding the temperature of engine cooling water from the temperature sensor 28. The electronic controller then controls the actuator 5 on the basis of the above data such that the idle rotation speed assumes a predetermined value. To explain the controlling of the actuator 5 with reference to FIG. 2, the pulse motor 25 is rotated forwardly or reversely in accordance with a positive or negative pulse which is produced by the electronic controller on the basis of the above data and hence the stopper 17 is moved to and fro. As a result, the free lever 14 is rotated counter-clockwise or clockwise together with attendant rotation of the throttle lever 13 to open or close the throttle valve 11, so that the rotation speed of the engine is controlled to the predetermined idle speed.

Figure 3:
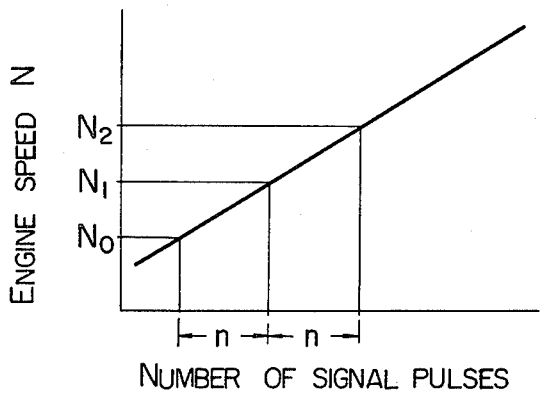
FIG. 3 is a graph showing the relation between actuator drive pulse and engine speed.

In the ISC, the electronic controller 9 delivers a pulse signal of a fixed width to the pulse motor 25 of the actuator 5. By receiving one pulse signal, the pulse motor 25 rotates a fixed angle and accordingly, the movement distance of the stopper 17 is rendered proportional to the number of signal pulses applied. Consequently, as shown in FIG. 3, the engine speed can be controlled substantially in linear relationship with the number of signal pulses applied to the pulse motor 25. More particularly, an engine speed of $N_0$ shifts to $N_1$ under the application of n signal pulses to the motor 25 and then shifts to $N_2$ under the application of additional n signal pulses. Thus, $(N_1-N_0)$ or $(N_2-N_1)$ is proportional to n to ensure that the engine speed is controlled in proportion to the number of signal pulses.

The electronic controller 9 controls the engine operation at a period of 40 msec in accordance with various programs. Especially, an ISC program is executed as will be described with reference to FIG. 4. When the flow of the program reaches an ISC mode 100, a counter included in the electronic controller 9 is applied with one count in step 101 and it is determined in step 102 whether or not the contents or count value of the counter is identical with the number of thinned frequencies. An explanation of the number of thinned frequencies will be given later. When "NO" is issued from step 102, the electronic controller 9 causes the pulse to be applied to the pulse motor 25 to fall to zero level in step 103, and the ISC program is exited. When "YES" is issued from step 102, it is determined in step 105 whether the microswitch 21 is switched on or switched off. When "OFF" is issued from step 105, indicating the depression of the accelerator pedal, which excludes the idle mode and does away with the ISC operation, the signal to be applied to the pulse motor 25 is at the zero level in step 106. When issuing "ON", step 105 proceeds to step 107 in which it is determined whether or not the difference $|N-Nset|$ between the engine speed N detected by the sensor 2 and a preset idle speed Nset is larger than an allowable range of idle speed $\pm\Delta N$, for example, $\pm 25$ rpm. When "NO" is issued from step 107, indicating that the difference $|N-Nset|$ is within the allowable range $\Delta N$, the present idle speed need not be changed and step 107 proceeds to step 106 which renders the pulse to be applied to the pulse motor 25 a zero level. When "YES" is issued from step 107, indicating that the engine speed exceeds the allowable idle speed, it is necessary to change the engine speed toward the preset value Nset. To optimize the control, the greater is the deviation of the engine speed N from the preset idle speed value Nset, the faster the change toward the preset value Nset whereas the smaller is the deviation, the slower the change.

Figure 5:
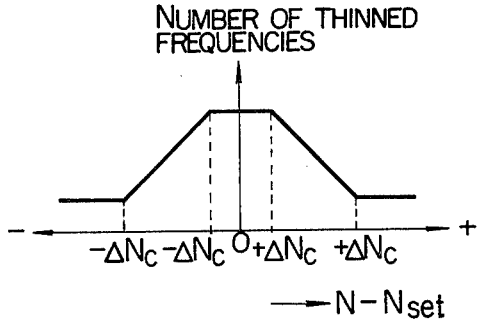
FIG. 5 is a graph useful in explaining part of the operation appearing in the program of FIG. 4.

Practically, it is not always necessary to execute the ISC program, at a 40 msec period and the period can be prolonged. Therefore, one execution of the ISC program out of several or several of tens of the ISC program occurrences will suffice. The number of frequencies at which the ISC program is not executed upon orderly occurrences of the ISC program is herein defined as the number of thinned frequencies. When a rapid change in the idle speed N, that is, a large $|N-Nset|$ is desired, the number of thinned frequencies is decreased. Conversely, when a slow change in N is desirable, the number of thinned frequencies is increased. Such a relationship is illustrated in FIG. 5. Since the mechanical actuator 5 cannot follow such a rapid control as occurs when the $|N-Nset|$ is increased beyond a predetermined value $\Delta Nc$, the number of thinned frequencies is fixed in this case.

Thus, when "YES" is issued from step 107, indicating that the engine speed N is required to change to the preset idle speed Nset, it is determined in step 108 whether or not the $|-Nset|$ is smaller than the predetermined limit $\Delta Nc$. When "NO" is issued from step 108, indicating that the $|N-Nset|$ exceeds the limit $\Delta Nc$, the number of fixed thinned frequencies is set in a memory in step 109. When "YES" is issued from step 108, the corresponding number of thinned frequencies as derived from the ramped linear characteristic shown in FIG. 5 is set in the memory. It is to be noted that, in step 102, the identity of the count value is compared with the number of thinned frequencies set in step 109 or 110.

Subsequently, it is determined in step 111 whether or not the preset value Nset is larger than the engine speed N. When $N \leqq Nset$, requiring that the actuator 5 be moved to open the throttle value, a positive output voltage is established, in step 112, which causes the pulse motor 25 to rotate forwardly. Conversely, when $N > Nset$ stands, the negative output voltage is established, in step 113, which causes the pulse motor 25 to rotate reversely. In this manner, one pulse rotates the pulse motor 25 forwardly or reversely in accordance with the polarity of this pulse. Subsequently, the count value set in step 101 correspond to the number of thinned frequencies set in steps 109 and 110 are cleared in step 115, and the ISC program is exited. After 40 msec following the delivery of the positive or negative output voltage from step 112 or 113, the ISC program as represented by step 100 reoccurs. But the first execution of the reoccurring ISC program is not carried out since step 102 issues "NO" and the output voltage is returned to zero level in step 103.

Consequently, the pulse to be applied to the pulse motor 25 has a width of 40 msec and one pulse is applied to the motor 25 each time the ISC program is executed according to the number of thinned frequencies set in step 109 or 110.

Figure 4:
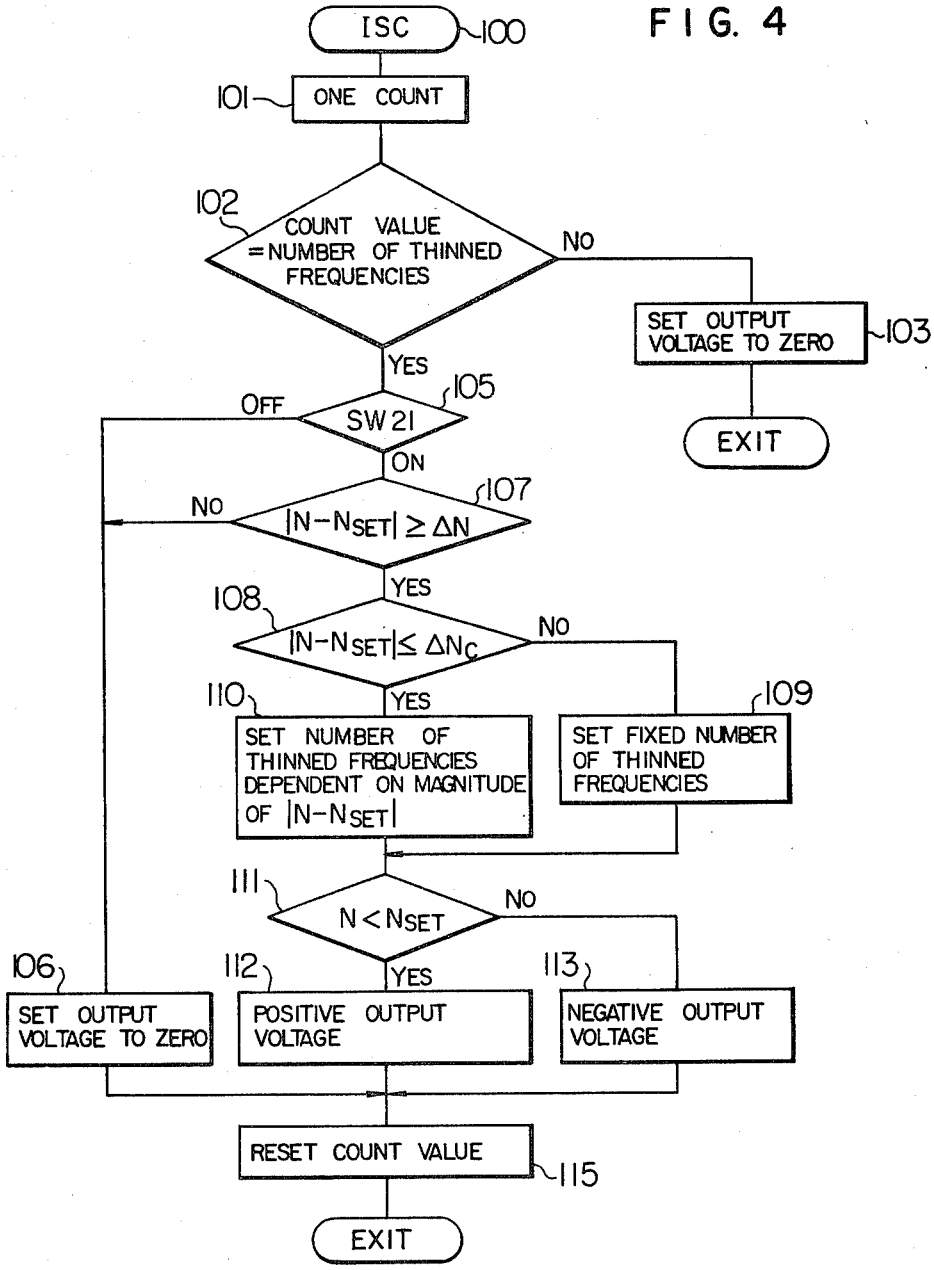
FIG. 4 is a flow chart for an idle speed control program.
Figure 6A:
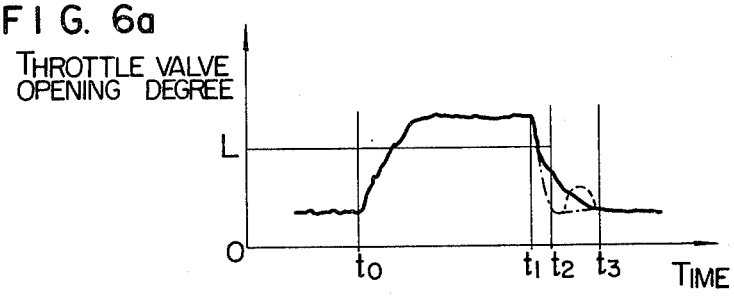
FIGS. 6*a* to 6*d* are graphic representations useful in explaining the control operation according to the invention.
Figure 6B:
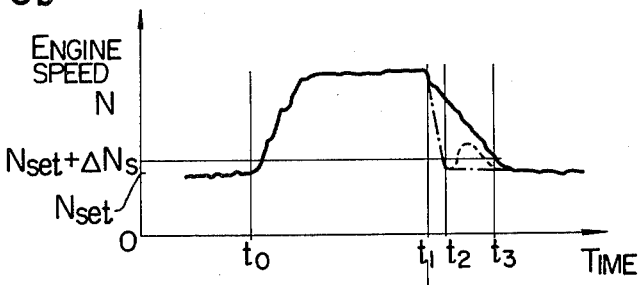
Figure 6C:
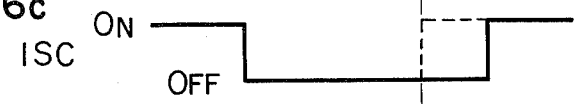

Referring now to FIGS. 6*a* to 6*d*, the operation following the depression of the accelerator pedal will be described. Prior to time $t_o$, the accelerator pedal 10 is not depressed and the microswitch 21 is switched on, so that the electronic controller 9 controls the actuator 5 in accordance with the ISC program tracing the flow chart as shown in FIG. 4 and as a result, the throttle valve 11 is so controlled that the engine speed N approximates the preset idle speed Nset as shown in FIG. 6*b*. With the depression of the accelerator pedal at time $t_o$, the microswitch 21 is switched off to disable the ISC programmed operation as shown in FIG. 6*c* and the engine speed is proportional to the opening degree of the throttle valve 11. When the accelerator pedal is released at time $t_1$, the throttle valve is displaced to a recovery position which is determined by the actuator 5. In this phase, a conventional system with the ISC channel alone impairs the running performance of automobiles as set forth in the foregoing description, since the engine speed is returned to the idle speed at the termination of an extremely short time interval of from $t_1$ to $t_2$ as shown at chained line in FIGS. 6*a*, 6*b* and 6*c*. Also, even with the above conventional system added with a throttle opener, an oscillatory change is attendant on the engine speed as shown at dotted line in FIGS. 6a, 6b and 6d, thus impairing the running performance of the automobile.

Figure 6D:
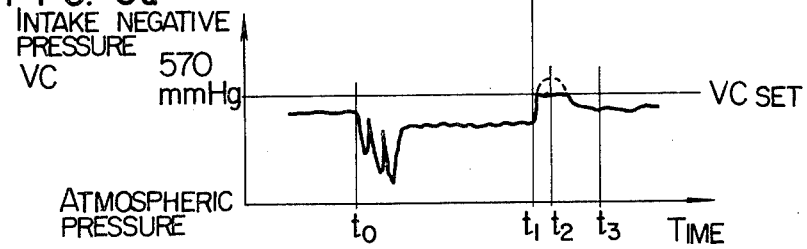
Figure 7:
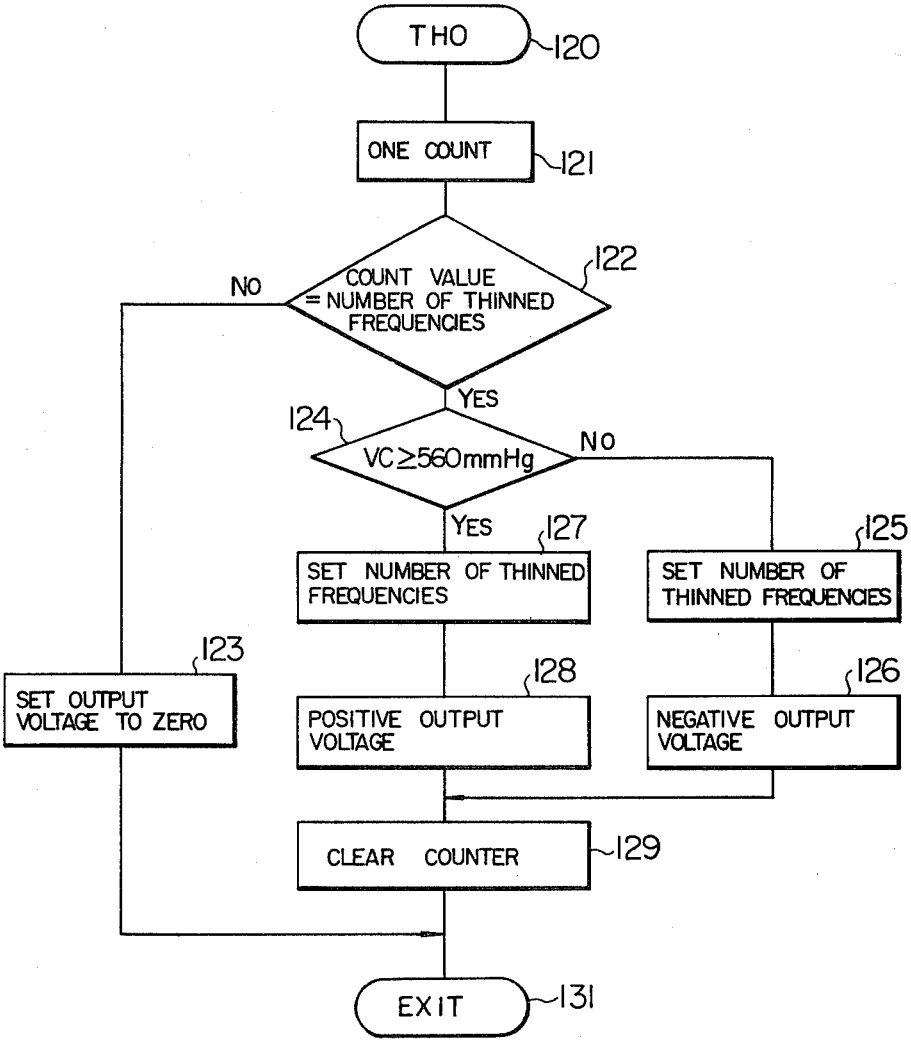
FIG. 7 is a flow chart for a throttle opener program.

In accordance with the present invention, however, the actuator 5 follows the motion of the depressed accelerator pedal to shift to a position corresponding to the opening degree L of the throttle valve as shown in FIG. 6a. This position is detected by the microswitch 26 shown in FIG. 2. The actuator 5 is maintained at this position until the accelerator pedal is released again. Accordingly, when the accelerator pedal is released at time $t_1$, the throttle valve is immediately returned to the opening degree L and thereafter, the engine speed is controlled along solid line in FIGS. 6a to 6d under the influence of negative pressure until time $t_3$ is reached at which time the engine speed recovers the idle speed and the ISC programmed operation commences. This negative intake pressure control, a, so-called throttle opener (THO) control, is carried out by the electronic controller 9 in accordance with a THO program as will be described with reference to FIG. 7. When the flow of the program reaches the THO program in step 120, one count is applied to a counter in step 121 and it is determined in step 122 whether or not the count value of the counter is identical with the number of thinned frequencies stored in a memory. When "NO" is issued from step 122, the voltage to be applied to the pulse motor 25 is at a zero level in step 123. When "YES" is issued from step 122, it is determined in step 124 whether or not the intake negative pressure is larger in the negative sense than −560 mmHg indicative of a preset negative pressure VCset as shown in FIG. 6d. When "NO" is issued from step 124, the number of thinned frequencies is set, in step 125, to a value at which the throttle valve is turned to close at a speed suitable for the dash-pot action, and the negative voltage is produced from step 126. When "YES" is issued from step 124, a relatively small number of thinned frequencies is set in step 127 and a positive voltage is produced from step 128. Subsequent to step 126 or 128, the counter to be counted in step 121 is cleared in step 129 and this program stops. The pulse motor 25 is rotated by one pulse forwardly or reversely in accordance with the voltage set in step 126 or 128. In the subsequent first THO program, step 122 issues "NO" and step 123 returns the output voltage set in step 126 or 128 in accordance with the previous last THO program to zero so that the width of the pulse to be applied to the pulse motor 25 is 40 msec.

Figure 8:
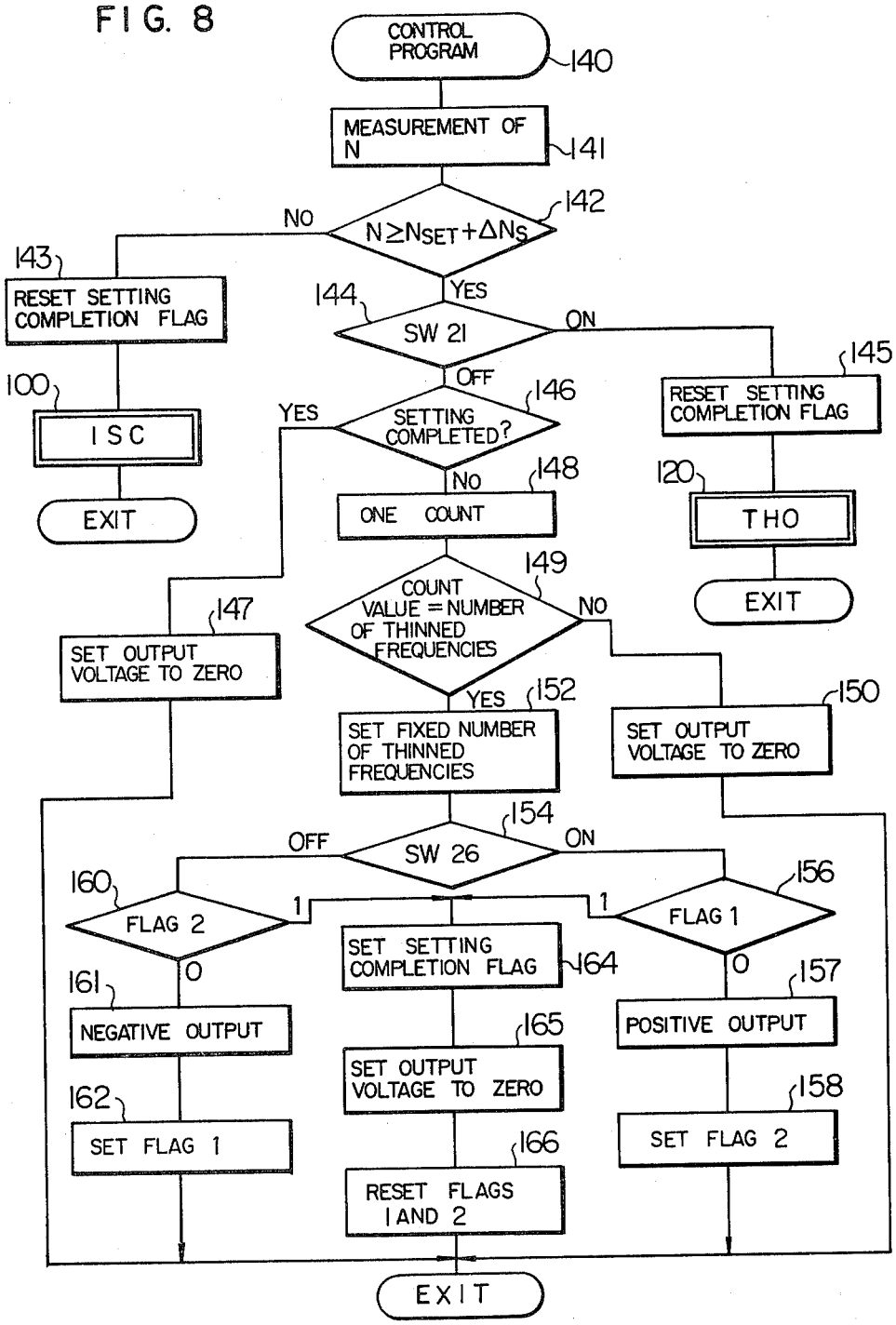
FIG. 8 is a flow chart for the overall program adapted for the essential parts participating in the rotation of the engine.

Referring now to FIG. 8, the overall control program of this invention including the ISC and THO programs will be described. Following each commencement of the control program in step 140, data regarding the engine speed N detected by the sensor 2 is fetched in step 141 and $N \geqq (Nset + \Delta Ns)$ is examined in step 142 to determined whether or not the engine speed exceeds the idle speed by the predetermined value $\Delta Ns$. When "NO" is issued from step 142, indicating that the engine speed is below the $Nset + \Delta Ns$ as shown in FIG. 6b, a setting completion flag to be described later is reset in step 143 and the control program proceeds to the ISC program 100 pursuant to FIG. 4. When "YES" is issued from step 142, the control program proceeds to step 144. It is determined in step 144 whether the microswitch 21 is switched on or switched off. When "ON" is issued from step 144, indicating that the engine speed exceeds the upper limit of idle speed $Nset + \Delta Ns$ even with the acceleration pedal released, a setting completion flag to be described later is reset in step 145 and the control program proceeds to the THO program 120 pursuant to FIG. 7.

When "OFF" is issued from step 144, indicating that the engine rotates at a speed above the upper limit of idle speed with the acceleration pedal depressed, the stopper 17 of the actuator 5 is shifted until the opening degree L as shown in FIG. 6a is attained. The microswitch 26 detects whether or not the throttle valve is so set as to locate the opening degree L. Thus, it is first determined in step 146, by using a setting flag to be described later, whether or not the throttle valve is set to a position corresponding to the preset opening degree L. When "YES" is issued from step 146, indicating that the pulse motor 25 need not be driven, the output voltage is set to zero in step 147 and the control program stops.

When "NO" is issued from step 146, indicating that the setting of the actuator 5 is necessary, a thinned frequency counter is applied with one count in step 148 and it is determined in step 149 whether or not the count value of the counter is identical with the number of thinned frequencies. When "NO" is issued from step 149, the voltage to be applied to the pulse motor 25 is set to zero level in step 150 and the control program is exited. When "YES" is issued from step 149, a fixed number of thinned frequencies is set in a memory in step 152. It is to be noted that the fixed number of thinned frequencies set in step 152 is used for comparison in step 149. Subsequently, it is determined in step 154 whether the microswitch 26 is switched on or switched off. When "ON" is issued from step 154, it is indicated that the free lever 14 must be to rotated to a position at which the microswitch 23 is switched off. In advance of the production of the voltage for rotating the free lever, it is determined in step 156 whether or not a flag 1 to be described later is set and when "0" indicating that the flag 1 is not set is issued from step 156, step 157 produces the positive voltage, step 158 sets a flag 2, and the control program is exited.

When step 154 determines that the switch 23 is off, the pulse motor 25 is to be rotated in reverse so as to rotate the free lever 142 clockwise until the microswitch 26 is switched on. To this end, when step 160 determines that the flag 2 is not set, a negative voltage is produced from step 161 to rotate the pulse motor 25 in reverse and the flag 1 is set in step 162.

After the switch 26 has been switched from on to off or vice versa by the motion of the actuator 5 and once the actuator is located at the predetermined position, it is necessary to stop the motion of the actuator. To this end, since "1", indicating that the flag is set, is always issued from step 160 or 156, whenever the flag 2 or 1 is set in step 158 or 162 and the switch 26 is then switched over, a flag indicative of setting completion of the actuator is set in step 164, the output voltage to be applied to the pulse motor 25 is rendered zero in step 165, the flags 1 and 2 are reset in step 166, and the control program is exited. It is to be noted that the flag set in step 164 is reset in steps 143 and 145 to make preparations for the programmed control following issuance of "OFF" from step 144. The judgement in step 146 depends on the flag to be set in step 164.

The execution of control program as shown in FIG. 8 will be explained move specifically by referring to FIGS. 6a to 6d. Prior to time $t_0$, the engine is in the idle mode, step 142 decides "NO" and the control is carried out in accordance with the ISC program 100. When the accelerator pedal is depressed at time $t_0$, the engine speed increases so that step 142 issues "YES" and step 144 decides that the switch 21 is switched off. Consequently, those steps following step 146 are executed in order to locate the actuator 25 at the preset position. If, in the course of this execution, the motion of the actuator 5 causes the free lever 14 to turn at a higher rate than that of the throttle lever 13, it is determined in step 144 that the switch 21 is switched on and the THO program is executed temporarily. In this manner, the actuator 5 is shifted until it stops at the position which locates the opening degree L shown in FIG. 6*a*. When the accelerator pedal is released at time $t_1$, the throttle valve 11 recovers the opening degree L shown in FIG. 6*a* and concurrently therewith, the switch 21 is turned on. Accordingly, "ON" is issued from step 144 and the THO program is executed. Subsequently, at time $t_3$, the engine speed N reaches Nset+ΔNs and step 142 issues "NO", bringing the control program into the ISC program. After time $t_3$, the controlling traces the same program as that executed prior to time $t_0$.

As described above, according to the foregoing embodiment, it is possible, by adding a simple mechanism to the throttle actuator 5 of the carburetor 6, to provide an engine rotation speed control system which can operate not only as the ISC system when the engine is in the idle mode so as to maintain the idle speed at the optimum value Nset dependent on operational parameters of the engine, but also as the throttle opener when the accelerator pedal is released following the depression thereof, in such a manner that when the accelerator pedal is depressed, the stopper 17 of the actuator 5 is rapidly shifted to the preset position corresponding to a larger opening degree L of the throttle valve than the idle opening thereof and when the accelerator pedal is released subsequently, the throttle valve 11 having a tendency toward rapid recovery to the idle opening is temporarily caught at the opening degree L, whereby the control can enter into the throttle opener operation in advance of time $t_2$. Accordingly, in contrast to the conventional system wherein before the throttle opener operates, the throttle valve 11 is once returned to the idle opening rapidly and the intake negative pressure VC exceeds the preset value VC set, the present invention prevents the transitional variation of the engine speed, engine stall, shocks in running and degrading of exhaust gas condition.

Incidentally, in the ECC operated by such a control system, when the engine is stopped by turning off the engine key switch, the recovery position of throttle valve determined by the actuator 5 is not always located definitely. This is because the engine key is turned off as desired irrespective of the engine operation to stop the engine and similarly, the actuator 5 has the possibility of taking on any position dependent on the engine operation immediately before the engine stoppage. Therefore, the opening degree of the throttle valve often deviates greatly from the opening degree suitable for starting the engine when the engine is actually started, resulting in failure to accurately start the engine. To solve this problem, according to the invention, after the key switch is turned on, the actuator is first set to bring the opening degree of the throttle valve into a value suitable for engine starting and thereafter the starter is actuated.

Figure 9:
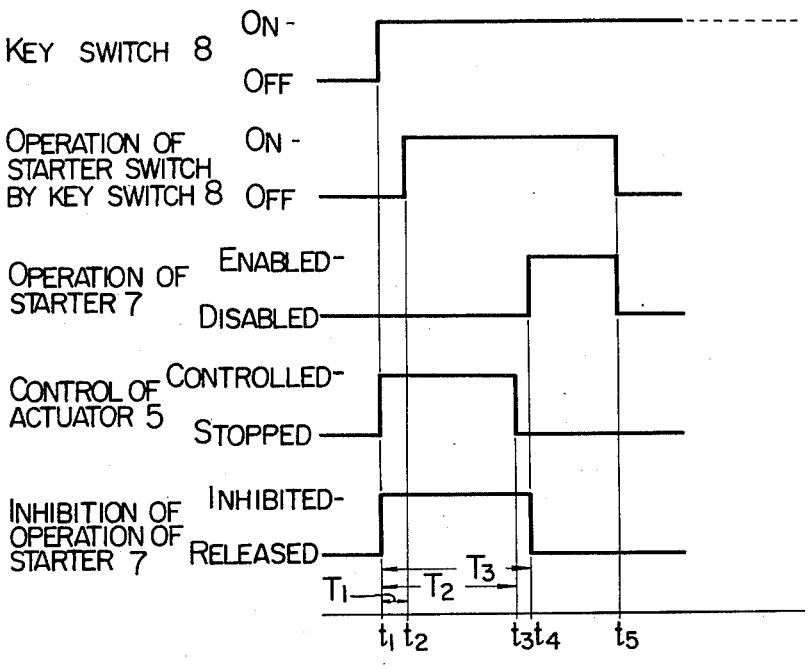
FIG. 9 is a time chart useful in explaining the engine start according to the invention.

To this end, the control system is embodied to operate as will be described with reference to FIG. 9. Prior to time $t_1$, the key switch 8 is turned off to stop the engine 1. When the key switch 8 is turned on at time $t_1$, the controller 9 starts operating so that a pulse is sent to the pulse motor 25 of the actuator 5 to ensure that the opening degree of the throttle valve 11 is controlled to the degree L shown in FIG. 6*a*. In advance of this control, the controller 9 sends a signal to the starter 7 to inhibit the actuation of the starter 7. Namely, a switch circuit connected in series with the key switch is turned off so as to inhibit the actuation of the starter 7 even when the key switch 8 is switched to the starter contact.

More specifically, at time $t_2$ which is slightly delayed lags with respect to time $t_1$, the key switch 8 is switched to the starter contact. Time lag $T_1$ from times $t_1$ to $t_2$ is variable dependent on individuality of persons handling the key switch 8 and not always definite. Even when the starter contact is closed at time $t_2$, the starter 7 is not actuated since the actuation thereof still remains inhibited.

During a time interval from times $t_2$ to $t_3$, the opening degree of the throttle valve 11 is first set to the degree L under the control of the actuator 5 by the controller 9, thus completing the control for initializing the throttle valve. Subsequently, the opening degree of the throttle valve is set from degree L to a degree which is switched for engine starting with a parameter of engine cooling water temperature. To this end, the number of pulses to be applied to the pulse motor 25 is calculated which is necessary for shifting the throttle valve to a position corresponding to the opening degree optimized for engine starting, and the pulse motor 25 is driven by the calculated number of pulses until the setting of the actuator is completed at time $t_3$. The opening degree of throttle valve can be calculated from the cooling water temperature as is well known in the art. Since this opening degree is in linear proportion to the position of actuator 5, the number of pulses can easily be calculated from water temperature.

At time $t_4$ which slightly lags time $t_3$, the controller 9 releases the inhibition of the starter actuation. At this time, if the starter contact is closed by the key switch 8, the starter 7 is actuated to start the engine 1.

Figure 10:
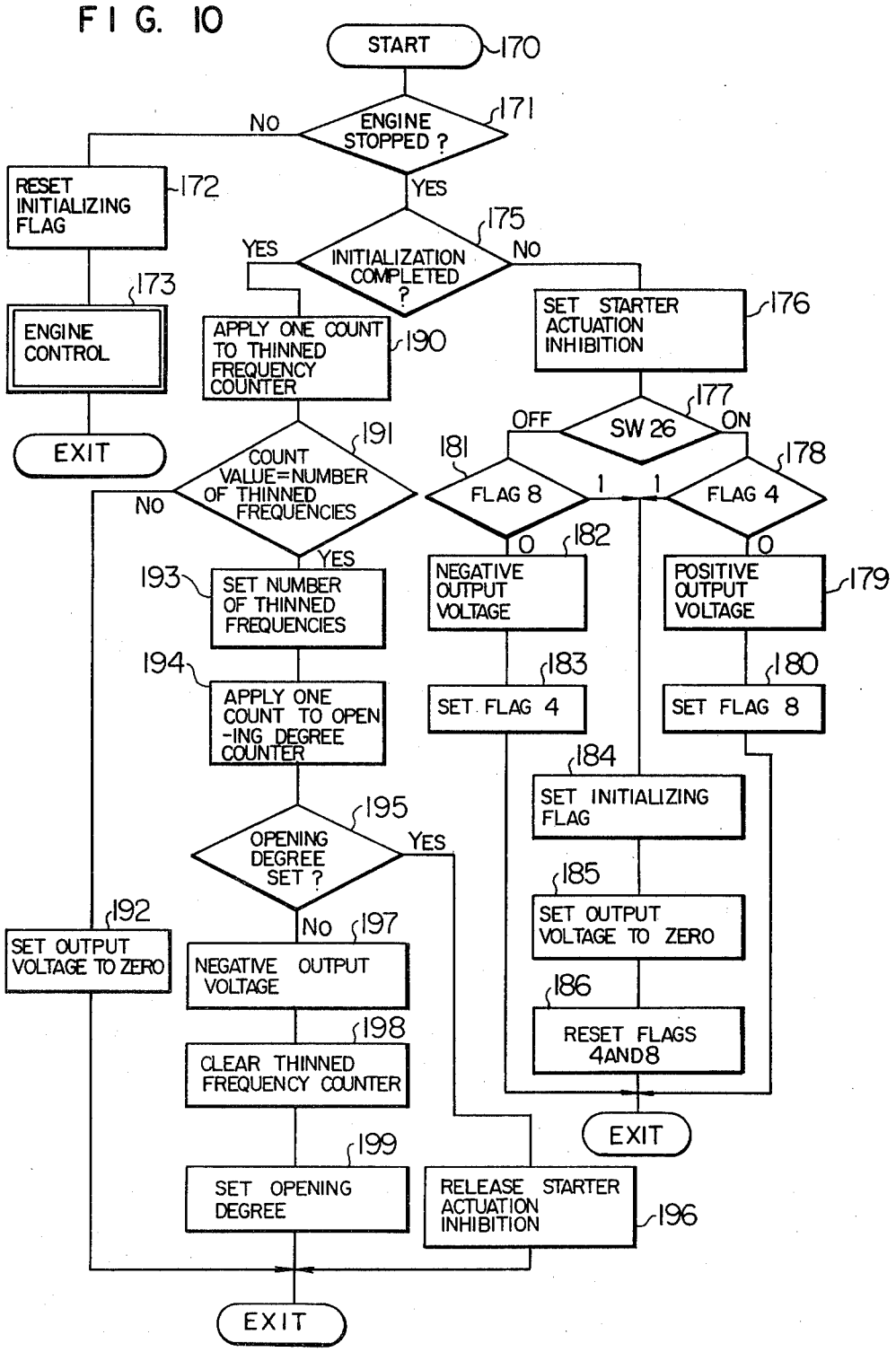
FIG. 10 is a flow chart for an engine start program.

The above operation is carried out by the electronic controller 9 in accordance with a program as will be described with reference to FIG. 10. When the key switch 8 is turned on, the program starts from step 170 and engine stopping is determined in step 171. When "NO" is issued from step 171, indicating that the engine is operating, step 172 resets an initializing flag to be described later and the program proceeds to step 173 in which the normal engine control is effected.

When "YES" is obtained from step 171, indicating that the engine is stopped, the start control according to the present invention commences. It is determined in step 175 whether or not the initialization is terminated. When "NO" is issued from step 175, actuation of the starter is inhibited in step 176 and it is determined in step 177 whether the switch 26 is on or off. Through step 177 to step 186, the same operation as effected through steps following step 154 shown in FIG. 8 is carried out and is not detailed herein. Briefly, the actuator is initialized through these steps and when the initialization is terminated, the initializing flag is set in step 184 so that the decision in step 175 is thereafter transferred to "YES".

Since the setting for initialization is effected by the microswitch 26, the throttle valve is set to the opening degree L shown in FIG. 6*a*. At this opening degree, the engine rotates at an extremely high speed and it is necessary that the engine start be effected at a smaller opening degree than the degree L. To this end, following the initialization, the actuator must be set by driving the pulse motor 25 in reverse. With the above in mind, the actuator setting following issuance of "YES" from step 175 will be described.

One count is applied to the thinned frequency counter in step 190 and it is determined in step 191 whether or not the count value is identical with the preset number of thinned frequencies. When "NO" is issued from step 191, the output voltage to be applied to the pulse motor 25 is zero and the program is exited off. When "YES" is issued from step 191, the predetermined number of thinned frequencies is stored in the memory in step 193. The above operation is the same as described with reference to FIGS. 4, 7 and 8.

Subsequently, one count is applied to an opening degree counter in step 194. It is then determined in step 195 whether or not the count value is identical with the number of pulses to be applied to the pulse motor which is calculated from water temperature. Identity in this step 195 means completion of setting for the opening degree. When "YES" is issued from step 195, indicating that setting of all the conditions for engine start is completed, the starter actuation inhibition as set in step 176 is released in step 196 and the program leaves off.

When "NO" is issued from step 195, indicating that the actuator is required to be displaced by the reverse rotation of pulse motor 25, a negative voltage is applied to the pulse motor 25 in step 197. The count value counted in step 190 is then cleared in step 198 and the number of pulses to be applied to the pulse motor 25 which is calculated from the water temperature is set in step 199. This number is subjected to the decision in step 195.

Figure 11:
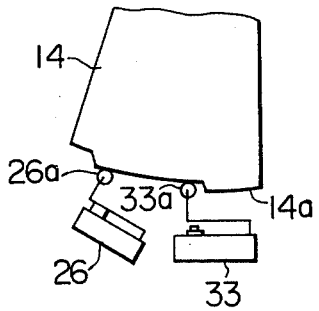
FIG. 11 is a fragmentary, diagrammatic representation showing a modification according to the invention.

As shown in FIG. 11, the cam surface 14*a* of the free lever may be modified so as to have two shoulders of which one is cooperative with the microswitch 26 for initialization of the THO program and the other is cooperative with a microswitch 33 for initialization upon engine starting. Further, the two microswitch 26 and 33 may be actuated independently by a single shoulder on the cam surface. In this case, by making the setting position of the actuator 5 by switch 33 correspond to the normal engine start, it is possible to reduce the time for setting of the actuator following completion of the initialization. To this end, in place of steps 197 and 198 in FIG. 10 through which only one directional rotation of the pulse motor is effected, the same steps as those ranging from step 177 to step 186 may be employed to assure bidirectional, forward and reverse, motor driving.

Returning to FIG. 9, a duration $T_2$ from times $t_1$ to $t_3$ required for the controller 9 to control the actuator 5 varies with the initial position of the stopper 17 included in the actuator 5 and is not always definite. But, since it takes an appreciable time $T_M$ at most for controlling the actuator, the duration $T_2$ may be fixed at a value which satisfies $T_2 \geqq T_M$, thus simplifying the program. In this case, a duration $T_3$ for the starter actuator inhibition ranging from times $t_1$ to $t_4$ may be expressed as $T_3 = T_2 + \Delta T$ ($\Delta T > 0$).

As described above, according to the invention, it is possible by adding a simple mechanism to the throttle valve of the carburetor to eliminate the prior art drawbacks faced in the ECC with the ISC and throttle opener functions, thereby providing a carburetor making full use of advantages of the ECC.

In the foregoing embodiments using a microcomputer as described with reference to FIGS. 4, 7, 8 and 10, a conventional microcomputer for ECC control may advantageously be adapted for the controller 9 by simply preparing additional programs.

Furthermore, according to the invention, upon engine starting, the opening degree of the throttle valve 11 can be set to predetermined degree irrespective of the preceding stopping state of the engine, thereby assuring steady starting of the engine. Thus, the invention can make full use of advantageous natures of the ECC and provide the engine control system removed of the prior art drawbacks and having excellent characteristics.

What is claimed is:

1. In an engine rotation speed control system comprising:

an actuator for prescribing the recovery position of a throttle valve;

recovery position sensor means for detecting that the throttle valve is brought into the recovery position;

an idle speed control unit for controlling said actuator such that an idling speed is obtained which is determined by operational parameters of said engine, when said throttle valve is placed in said recovery position; and a negative pressure restricting unit for controlling, in preference to the control by means of said idle speed control unit, said actuator such that a reduction in intake negative pressure for said engine to below a preset negative pressure is prevented;

engine stopped sensor means for detecting that said engine is stopped;

initial position setting means for initializing said actuator such that said recovery position takes a predetermined position, when the key switch for engine start is closed during the stopped of said engine; and start position setting means for setting said recovery position of the throttle valve by said actuator such that the opening degree of the throttle valve is obtained which meets the initial state of said engine, when initialization by said initial position setting means is completed.

2. An engine rotation speed control system according to claim 1, which further comprises means for inhibiting starting of said engine until the setting by said start position setting means is completed, when said engine stoppage sensor means detects that said engine is in stopped.

3. An engine rotation speed control system according to claim 1 wherein said initial position setting means comprises:

a drive unit for driving said actuator forwardly or backwardly;

sensor means for detecting whether said actuator is placed forwardly or backwardly of said predetermined position;

means for controlling the drive unit such that the actuator is retreated to said predetermined position when placed forwardly of said predetermined position and is advanced to said predetermined position when placed backwardly of said predetermined position; and means for stopping said drive unit when said actuator reaches said predetermined position under the control of said controlling means.

4. A method of operating an engine speed control system wherein the position of a throttle valve is adjusted so as to control engine speed upon the starting of the engine, said throttle valve being displaced in a first direction for an increase in engine speed and in a second direction for a decrease in engine speed, comprising the steps of:

(a) establishing the position to which said throttle valve recovers for an at-rest state of said throttle valve;

(b) in response to the application of an engine starting request, causing the recovery position of said throttle valve to be established at a first prescribed position;

(c) in response to said recovery position of said throttle valve being established at said first prescribed position in step (b), adjusting said recovery position to a second position dependent upon an operation parameter of the engine; and (d) inhibiting the starting of the engine until the completion of step (c), and thereafter permitting said engine to be started in accordance with said starting request.

5. A method according to claim 4, wherein said first prescribed position is a recovery position which will result in an engine operation speed higher than the operation speed of said engine for the recovery position of the throttle valve during idling of the engine.

6. A method according to claim 5, wherein step (c) comprises the step of adjusting said recovery position to a second position which causes a decreasing opening of the throttle valve and a corresponding reduced engine speed relative to higher engine operation speed.

7. A method according to claim 6, wherein said operational parameter corresponds to the temperature of the engine coolant.

8. A method according to claim 6, wherein step (c) comprises the step of incrementally adjusting said recovery position to said second position at a prescribed frequency.

9. A method according to claim 8, wherein step (c) comprises the steps of:

(c1) incrementing a count value;

(c2) comparing said count value with a reference count established in accordance with said operational parameter of the engine;

(c3) adjusting said recovery position by a prescribed amount; and (c4) repeating steps (c1)–(c3) until said incremented count value equals said reference count, and thereupon terminating the adjusting of said recovery position at said second position.

* * * * *